United States Patent [19]

Kakuta et al.

[11] Patent Number: 4,933,723

[45] Date of Patent: Jun. 12, 1990

[54] RESIN COATED TRANSFER GUIDE FOR ELECTROPHOTOGRAPHIC APPARATUS

[75] Inventors: Atsushi Kakuta, Hitachiota; Tetsuo Ishikawa, Hitachi; Makoto Kobayashi, Ibaraki, all of Japan

[73] Assignee: Hitachi, Ltd., Tokyo, Japan

[21] Appl. No.: 202,026

[22] Filed: Jun. 3, 1988

[30] Foreign Application Priority Data

Jun. 5, 1987 [JP] Japan ..... 62-139805

[51] Int. Cl.[5] ..... G03G 15/14

[52] U.S. Cl. ..... 355/271; 271/107; 355/274; 428/458

[58] Field of Search ..... 355/271, 273, 274, 272, 355/315, 224; 271/107; 428/458

[56] References Cited

U.S. PATENT DOCUMENTS

| | | | |
|---|---|---|---|
| 3,508,824 | 4/1970 | Leinbach | 355/315 |
| 4,491,407 | 1/1985 | Mitsuyama | 355/274 |
| 4,588,279 | 5/1986 | Fukuchi | 355/271 |
| 4,641,948 | 2/1987 | Nakahata | 355/224 |

FOREIGN PATENT DOCUMENTS

| | | |
|---|---|---|
| 10766 | 1/1983 | Japan . |
| 10767 | 1/1983 | Japan . |
| 113455 | 6/1984 | Japan . |

*Primary Examiner*—A. T. Grimley
*Assistant Examiner*—Thu Dang
*Attorney, Agent, or Firm*—Antonelli, Terry, Stout & Kraus

[57] ABSTRACT

An electrophotographic apparatus comprising an electrophotographic photosensitive member, a means of forming an electrostatic latent image on the photosensitive member by an electrostatic method, a means of developing the latent image with a developer, a means of conveying a recording medium onto which the developer image is transferred, and a means of transferring the developer image onto the recording medium, wherein, a guide installed in the means of conveying the recording medium is partly coated with a resin film, with which the recording medium is brought into contact, so as to have a volume resistivity of $10^{12}$ to $10^{16}$ Ωcm at normal temperature and humidity, that is, at 20° C. and 50% RH and abrasion loss of 5 mg or below as measured in accordance with Taber's test method (load 1.0 Kg, revolution 70 rpm, total number of revolutions $1\times10^3$).

5 Claims, 1 Drawing Sheet

RESULTS OF TABER'S ABRASION TEST

RESIN COATED TRANSFER GUIDE FOR ELECTROPHOTOGRAPHIC APPARATUS

BACKGROUND OF THE INVENTION

1. Field of the Invention

The present invention relates to a guide which is positioned in the transfer section of an electrophotographic copying machine or printer and assists the conveyance of recording media onto which images will be transferred. Particularly, the invention is directed to a best suited guide for such purposes as mentioned above which is highly resistant to severe environments and has high durability to offer a long service life.

2. Description of the Prior Art

When patterns developed on electrophotographic photosensitive plates are transferred onto recording papers by corona charging, there have so far been used transfer devices which are provided with guides having volume resistivities of about $10^5$–$10^{10}$ Ωcm for conveying recording papers properly. For example, Japanese Patent Application Laid-Open Nos. 10766/83 and 10767/83 describe such guiding means. However, particularly in duplicating for a long time or a large number of copies or prints in a high-temperature atmosphere, the surface layer of such a guide is worn out, causing the necessity of exchanging a part of the transfer section.

The above prior art, taking into account only the retention of initial electrical characteristics, is not only insufficient in the control of resistance against the leak of electric current used for the transfer but also inadequate in considering the abrasion resistance of the guide from the viewpoint of duplicating a large number of copies or prints.

SUMMARY OF THE INVENTION

The primary object of the present invention is to provide a coated transfer guide which has such environment-resistant characteristics as to operate properly over wide ranges of temperatures and humidities and in addition has abrasion resistance sufficient to withstand the duplication of a great number of copies or prints.

According to the present invention, there is provided an electrophotographic apparatus comprising an electrophotographic photosensitive member, a means of forming an electrostatic latent image on said photosensitive member by an electrostatic method, a means of developing said latent image with a suitable developer, a means of conveying a recording medium onto which the developer image is transferred, and a means of transferring the developer image onto the recording medium, wherein, a guide installed in the means of conveying the recording medium is partly coated with a resin film, with which the recording medium is brought into contact, so as to have a volume resistivity of $10^{12}$ to $10^{16}$ Ωcm at normal temperature and humidity, that is, at 20° C. and 50% RH and abrasion loss of 5 mg or below as measured in accordance with Taber's test method (load 1.0 Kg, revolution 70 rpm, total number of revolutions $1\times10^3$, test method; ASTM D1044, JIS K7204).

Poly(amide-imide) resin is effective in particular as a guide coating material. Specific volume resistivities of guide coating materials have significant effects. It can be pointed out that the coating material of the present invention has a volume resistivity in the optimum range. That is to say, when the volume resistivity is less than $10^{12}$ Ωcm, the transfer of developer images onto recording media will be imperfect and in particular the transfer onto paper under high-humidity conditions will be markedly defective. On the contrary, when the volume resistivity exceeds $10^{16}$ Ωcm, electric charge on the guide itself will increase at each of repeated transfer operations, eventually resulting in defective separations of recording media from the guide surface and stains due to developer adhesion to undesirable areas of recording media. The optimum volume resistivity ranges from $10^{12}$ to $10^{16}$ Ωcm.

In the case of conventional guides, the portions of contact with recording media are liable to wear. While abrasion resistance is therefore required of the guides, the coating resin of the present invention shows a Taber's test abrasion loss of 5 mg or below (load 1.0 Kg, revolution 70 rpm, total number of revolutions $1\times10^3$) thus being excellent in abrasion resistance. The guiding means of the invention is also superior in water resistance and surface hardness.

Materials conventionally used for guide coating include polyethylene, polyethylene with carbon dispersed therein, epoxy resin, etc. On the other hand, a number of resins such as epoxy, alkyd, polyimide, polyamide, and fluorocarbon resins are known as coating resins for painting or coloring structural members.

As a result of examining and comparing various such resins generally known, the present inventors have found that poly(amide-imide) resin is effective outstandingly in achieving the above noted object of the invention. Based on this finding, the invention has been accomplished. That is, poly(amide-imide) resin has a volume resistivity ranging from $10^{12}$ to $10^{16}$ Ωcm and is superior in abrasion resistance, water resistance, and surface hardness.

A particular reason for the preference of this resin is its high resistance to surface abrasion resulting from the passage of recording media on its surface. When the recording medium is paper, the surface abrasion is conceivably caused by a rigid inorganic component of the paper. Most of common coating materials are worn out in about 10,000 sheets of paper passed thereon, hence being unfit for practical use. On the contrary, the present inventive resin material of about 30 μm in thickness showed a service life of over $1\times10^5$ sheets passed. Thus, it has been found that the present resin coat 30 μm or more thick is sufficient for use in usual electrophotographic copying machines or printers.

Further improvements of the present inventive resin material in properties can be achieved by incorporating one or more additives usable in many other common coating materials. Such additives include; fillers such as glass fiber, carbon, metal powders, and ceramic powders, which improve mechanical properties; and dispersants, stabilizers to ultraviolet rays, pigments, coupling agents, etc. In particular, rigid ceramic powders of the silicon nitride family can provide preferred combinations with the present resin.

The moderate softness and excellent toughness of poly(amide-imide) is considered to account for such excellent performance of this resin as a guide coating material.

The molecular weight of poly(amide-imide) used herein is desirably at least 10,000.

It may be noted that the voltage occurred due to the abrasion of guide can be dropped by introducing the wiring with a resistor between the surface of guide and the earth.

DESCRIPTION OF THE PREFERRED EMBODIMENTS

Figure 1:
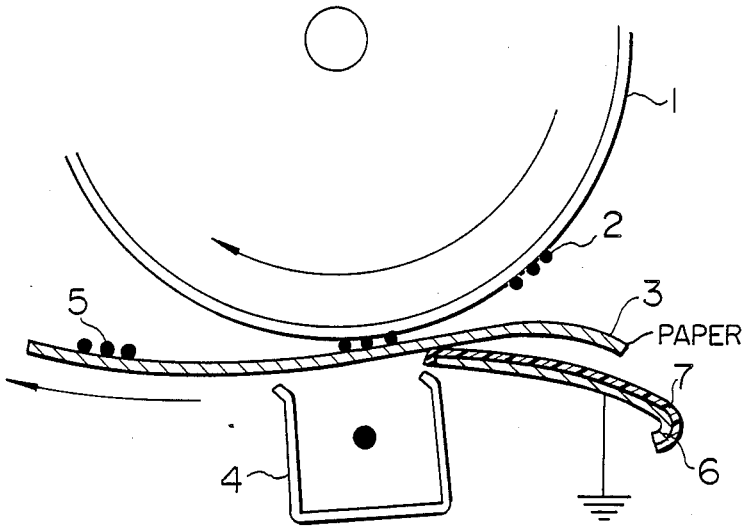
FIG. 1 is a schematic view of a transfer section equipped with a guide based on the present invention.

Referring to the drawings, embodiments of the present invention are described below.

EXAMPLE 1

FIG. 1 illustrates a transfer section equipped with a guide based on the invention, wherein

1 is an electrophotographic photosensitive member,

2 is a toner image developed on a part of the photosensitive member, the part being not shown in this drawing,

3 is a paper onto which the toner image is transferred,

4 is a corona charging unit for the transfer,

5 is a toner image transferred onto the paper,

6 is an electroconductive metallic base plate which is a part of the present inventive transfer guide, and

7 is a poly(amide-imide)-containing layer which is another part of the present inventive transfer guide.

Said poly(amide-imide)-containing layer was formed by spraying a coating liquid of composition shown in Table 1 onto said base plate, and heating the coat at 200° C. for 20 minutes to cure it. The cured, baked coat was 30 μm thick and the volume resistivity thereof was $2\times10^{15}$ Ωcm. The performance of the transfer guide formed in this example die not lower during the duplication of $1\times10^{5}$ copies at temperatures ranging from 0 to 60° C. and humidities ranging from 10 to 90% RH. The volume resistivity of the coat was $10^{12}$ Ωcm after 72 hours' standing at 60° C. and 90% RH.

TABLE 1

| | |
|---|---|
| Poly(amide-imide) (molecular weight 20,000–30,000) | 26 parts by wt. |
| Silicon nitride | 8 parts by wt. |
| Solvent: N-Methylpyrrolidone | 66 parts by wt. |

EXAMPLE 2

A transfer guide was fabricated according to the procedure of Example 1 except that the curing treatment was conducted at 250° C for 20 minutes and the coat thickness was changed to 50 μm. The performance of this guide did not lower during the duplication of $3\times10^{5}$ copies. The volume resistivity of the coat was $2\times10^{15}$ Ωcm at normal temperature and humidity and was $7\times10^{14}$ Ωcm after 72 hours' standing at 60° C. and 90% RH.

COMPARATIVE EXAMPLE 1

A transfer guide was fabricated according to the procedure of Example 1 except that the coating layer of the guide was formed of a 20 μm thick epoxy resin film cured at 200° C. Use of this guide, in duplication of 10,000 copies, already resulted in defective transfer traceable to the abrasion of the guide. In addition, when this guide was used in an atmosphere of 80% RH, defective transfer due to the leak of electric charge was already observed in the initial stage of operation. After 72 hours' standing at 60° C. and 90% RH, this guide showed a volume resistivity of $10^{10}$ Ωcm.

EXAMPLE 3

Figure 2:
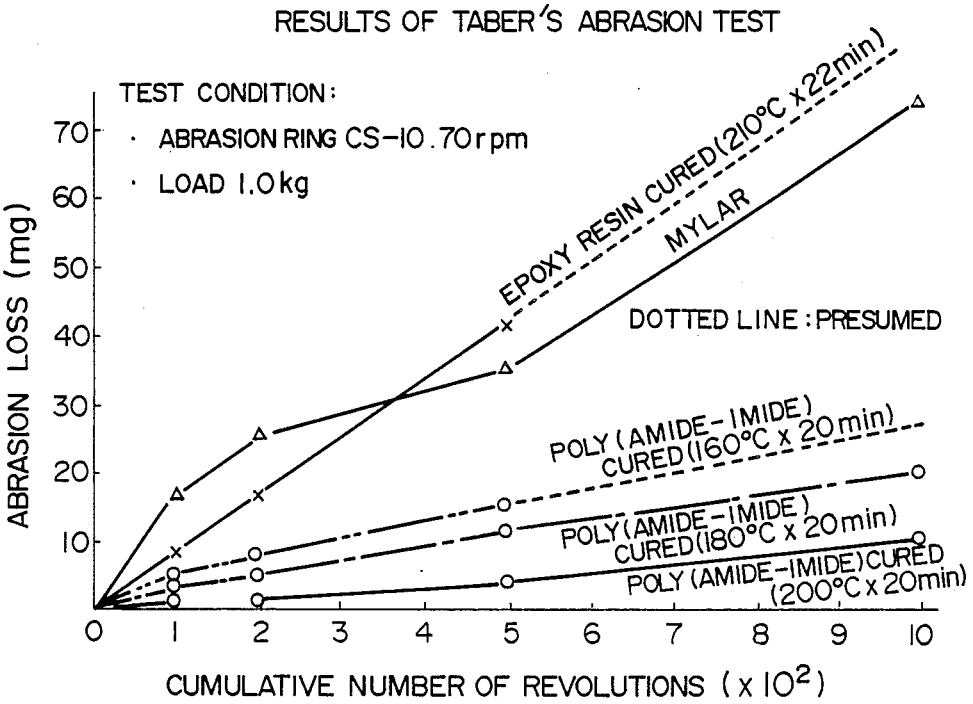
FIG. 2 shows results of Taber's abrasion tests on different materials, indicating the relation of the abrasion loss to the cumulative number of revolutions.

Tests were made to compare the volume resistivities, abrasion losses (Taber's abrasion test), water absorptions, and surface hardnesses (pencil hardnesses) of various resins. Results of the tests are shown in Table 2 and results of Taber's abrasion test in FIG. 2. Referring to poly(amide-imide) of the resins tested, the volume resistivity was in the optimum range of $10^{12}$ to $10^{16}$ Ωcm, the Taber's test abrasion loss was 5 mg, which was less than those of all the other resins, the water absorption was also on a relatively low level of 0.1%, and the surface hardness was a highest value of 6H. Thus, poly(amide-imide) has a volume resistivity in the optimum range and is superior in abrasion resistance, water resistance, and surface hardness.

EFFECT OF THE INVENTION

According to the present invention, it is possible to provide a transfer recording medium guide which is stable over wide ranges of temperatures and humidities and excellent in abrasion resistance. Hence, the present guide can be used favorably as an environment-resistant, long-life member for various electrophotographic copying machines and printers.

TABLE 2

| Resin | Volume resistivity (Ωcm): Normal temperature and humidity | Volume resistivity (Ωcm): 40° C., 80% RH | *1 Taber's test abrasion loss (mg) | Water absorption (%) | *2 Surface hardness |
|---|---|---|---|---|---|
| Polyethylene | $\geqq10^{16}$ | $10^{14}$ | ≧100 | 0.01≧ | H |
| Carbon-containing polyethylene | $10^{12}\geqq$ | $10^{12}\geqq$ | ≧100 | 0.01 | B |
| Epoxy resin | $10^{14}$–$10^{15}$ | $10^{12}\geqq$ | 70 | 0.3 | 3H |
| Alkyd resin | $10^{13}$ | $10^{12}\geqq$ | ≧100 | 0.5 | H |
| Polyimide | $10^{14}$–$10^{15}$ | $10^{12}\geqq$ | 10 | 0.6 | 6H |
| Polyamide | $10^{12}$–$10^{13}$ | $10^{12}\geqq$ | ≧100 | 1–2 | 2H |
| Fluorocarbon resin | $10^{15}$ | $10^{12}$–$10^{13}$ | 20 | 0.01 | H |
| Poly (amide-imide) | $10^{14}$–$10^{16}$ | $10^{12}$–$10^{14}$ | 5 | 0.1 | 6H |

*1 Taber's abrasion test method (ASTM D-1044, JIS K-7204) (load 1.0 Kg, revolution 70 rpm, total revolution 10,000)

*2 Pencil surface hardness test method (JIS K 5400-6-14)

What is claimed is:

1. An electrophotographic apparatus comprising an electrophotographic photosensitive member, a means of forming an electrostatic latent image on said photosensitive member by an electrostatic method, a means of developing said latent image with a developer, a means of conveying a recording medium onto which the developer image is transferred, and a means of transferring the developer image onto the recording medium, wherein, a guide installed in said means of conveying the recording medium is partly coated with a resin-contained film, with which the recording medium is brought into contact, so as to have a volume resistivity of $10^{12}$ to $10^{16}$ Ωcm at normal temperature and humidity, that is, at 20° C. and 50% RH and abrasion loss of 5 mg or below as measured in accordance with Taber's test method (load 1.0 Kg, revolution 70 rpm, total number of revolutions $1\times10^{3}$).

2. The electrophotographic apparatus of claim 1, wherein the surface of the resin coat has a pencil hardness of at least 6H.

3. An electrophotographic apparatus comprising an electrophotographic photosensitive member, a means of forming an electrostatic latent image on said photosensitive member by an electrostatic method, a means of developing said latent image with a developer, a means of conveying a recording medium onto which the developer image is transferred, and a means of transferring the developer image onto the recording medium, wherein a guide installed in said means of conveying the recording medium is partly coated with a poly(amide-imide) film, with which the recording medium is brought into contact; the poly(amide-imide) film having a volume resistivity of $10^2$ to $10^{16}$ Ωcm at normal temperature and humidity, that is, at 20° C. and 50% RH.

4. An electrophotographic apparatus comprising an electrophotographic photosensitive member, a means of forming an electrostatic latent image on said photosensitive member by an electrostatic method, a means of developing said latent image with a developer, a means of conveying a recording medium onto which the developer image is transferred, and a means of transferring the developer image onto the recording medium, wherein a guide installed in said means of conveying the recording medium is partly coated with a poly(amide-imide) film, with which the recording medium is brought into contact; the abrasion loss of the poly(amide-imide) film being 5 mg or below as measured in accordance with Taber's test method (load 1.0 Kg, revolution 70 rpm, total number of revolutions $1 \times 10^3$).

5. An electrophotographic apparatus comprising an electrophotographic photosensitive member, a means of forming an electrostatic latent image on said photosensitive member by an electrostatic method, a means of developing said latent image with a developer, a means of conveying a recording medium onto which the developer image is transferred, and a means of transferring the developer image onto the recording medium, wherein a guide installed in said means of conveying the recording medium is partly coated with a poly(amide-imide) film, with which the recording medium is brought into contact; the poly(amide-imide) film having a molecular weight of at least 10,000.

* * * * *